US007769329B2

(12) United States Patent
Shimura et al.

(10) Patent No.: US 7,769,329 B2
(45) Date of Patent: Aug. 3, 2010

(54) IMAGE FORMING APPARATUS THAT DRIVES PLURAL IMAGE FORMING STATIONS WITH COMMON MOTOR

(75) Inventors: Noriaki Shimura, Shiojiri (JP); Nobutaka Suzuki, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 911 days.

(21) Appl. No.: 11/551,600

(22) Filed: Oct. 20, 2006

(65) Prior Publication Data

US 2007/0092297 A1 Apr. 26, 2007

(30) Foreign Application Priority Data

Oct. 21, 2005 (JP) ..... 2005-307543
Oct. 21, 2005 (JP) ..... 2005-307544

(51) Int. Cl.
*G03G 15/01* (2006.01)

(52) U.S. Cl. ..... 399/299; 399/302

(58) Field of Classification Search ..... 399/107, 399/112, 116, 117, 167, 299, 302, 303, 92
See application file for complete search history.

(56) References Cited

U.S. PATENT DOCUMENTS 4,803,515 A * 2/1989 Hoshino et al. ..... 399/299
4,928,144 A * 5/1990 Kasahara et al. ..... 399/228
5,386,286 A * 1/1995 Kinouchi et al. ..... 399/228
6,142,690 A * 11/2000 Yoshimura et al. ..... 400/636.2
6,708,013 B2 * 3/2004 Nomura ..... 399/167
7,437,098 B2 * 10/2008 Kim et al. ..... 399/167

FOREIGN PATENT DOCUMENTS

JP 03038662 A * 2/1991
JP 09325591 A * 12/1997
JP 10031338 A * 2/1998
JP 10307442 A * 11/1998
JP 11-024356 A 1/1999
JP 2001165149 A * 6/2001
JP 2005265951 A * 9/2005

* cited by examiner

*Primary Examiner*—Robert Beatty
(74) *Attorney, Agent, or Firm*—Hogan Lovells US LLP

(57) ABSTRACT

An image forming apparatus has plural image forming stations along a travel direction of a transfer medium. Each image forming station has a latent image carrier that rotates in a sub scanning direction, an image writer that forms a latent image on the latent image carrier and a developer that has a toner carrier extending along a main scanning direction approximately perpendicular to the sub scanning direction. Each image writer has a line head near the latent image carrier with light emitting elements arranged in a row along the main scanning direction. Rotation drive force developing at one common motor is transmitted to plural places in sections of the apparatus to superimpose toner images one atop the other. A motor main section of the common motor overlaps the transfer medium in the in-plane arrangement viewed from a vertical direction perpendicular to both the main and sub scanning directions.

5 Claims, 9 Drawing Sheets

IMAGE FORMING APPARATUS THAT DRIVES PLURAL IMAGE FORMING STATIONS WITH COMMON MOTOR

CROSS REFERENCE TO RELATE APPLICATION

The disclosure of Japanese Patent Applications enumerated below including specification, drawings and claims is incorporated herein by reference in its entirety:

No. 2005-307543 filed Oct. 21, 2005; and

No. 2005-307544 filed Oct. 21, 2005.

BACKGROUND

1. Technical Field

The present invention relates to an image forming apparatus of the tandem type which has plural image forming stations. The stations are disposed along a travel direction (sub scanning direction) in which a transfer medium which may be a transfer belt or the like moves. Toner images formed by the respective image forming stations are superimposed one atop the other, and a color image is consequently formed.

2. Related Art

As JP-A-11-24356 specified below for instance discloses, among known image forming apparatuses such as copier machines, printers and facsimile machines is an image forming apparatus of the so-called tandem type. The apparatus has plural image forming stations which form toner images of mutually different colors from each other. The stations are disposed along a transfer belt which runs in a predetermined direction. In each image forming station, a latent image carrier such as a photosensitive drum for the associated toner color is disposed, and so is a laser beam scanner unit (image writer) for the photosensitive drum. Each laser beam scanner unit comprises a semiconductor laser element, a deflector and an imaging optical system such as an fθ lens. The semiconductor laser element emits dot light modulated in accordance with image data. The deflector deflects the light from the semiconductor laser element to a main scanning direction. The imaging optical system focuses the laser light deflected by the deflector as an image on the surface of the photosensitive member. The laser beam scanner units form latent images on the associated photosensitive drums and developer units make toner adhere to the photosensitive drums, whereby toner images corresponding to the latent images are formed. In this fashion, the toner images in the respective colors are formed and superimposed one atop the other on the surface of the transfer belt so that a color image is formed. The color image formed on the belt surface is transferred onto a transfer medium such as a paper sheet.

The apparatus described above comprises two drive motors which drive the respective sections of the apparatus such as a drive roller which drives the transfer belt, the photosensitive drums, etc. The photosensitive drums on which images in colors are to be formed are equipped with gears which are attached to central axes of the photosensitive drums, and the gears are linked to a first motor by a timing belt via an idle gear. Meanwhile, the photosensitive drum on which a black image is to be formed is equipped with a gear which is attached to a central axis of the photosensitive drum, and this gear is linked to a second motor via an idle gear. Further, a gear is attached to a central axis of the drive roller for the transfer belt, and linked also to the second motor via an idle gear. A gear is attached to a central axis of fixing apparatus as well, and linked also to the second motor via an idle gear.

SUMMARY

By the way, in the conventional apparatus described above, each of the motors is linked to the plural rollers through drive transmission members such as gears, and functions as a common motor. This puts a relatively great load upon the common motors, and therefore, motor main sections (rotors, stators and cases which house the both) of the common motors are inevitably big. Further, the image writers used in the conventional apparatus make light from the semiconductor laser elements scan in the main scanning direction via the deflectors and the imaging optical systems. Thus, the common motors are located on the side of the image forming stations, the transfer belt or the like in an attempt to prevent interference between the image writers and the motor main sections of the large-sized common motors. In short, the common motors are disposed with their motor main sections sticking out in the main scanning direction from the image forming stations, the transfer belt, etc. This gives rise to a problem that it is not possible to properly meet the demand for size reduction of the apparatus.

In addition, with respect to image forming apparatuses of this type, numerous techniques have been proposed which would reduce the amount of toner to be held in developers of developer units while replenishing toner to the developers from separately disposed toner replenishing containers. Among those proposals, some are directed to an apparatus in which toner replenishing containers are disposed at axial edge sections of developers, for the purpose of making it easy even for a user to maintain the apparatus. In an apparatus having such a structure, a user can access the toner replenishing containers from the front surface side of the apparatus, which ensures excellent maintainability. However, the toner replenishing containers are disposed at the axial edge sections of the developers. Thus, the containers protrude in their entirety or partially along the axial direction of the developers (main scanning direction) and increase the size of the apparatus along this direction. If the size expansion is attributable only to the toner replenishing containers, it should be possible to minimize the magnitude of the size expansion with improvement of the shape or the like of the toner replenishing containers. However, the following drive structure is used in this apparatus for the purpose of driving the respective sections of the apparatus such as the drive roller and the photosensitive drums. Therefore, even despite improvement of the shape, the size or the like of the toner replenishing containers, expansion of the size of the apparatus is unavoidable.

The apparatus described above comprises two drive motors which drive the respective sections of the apparatus, such as the photosensitive drums and the drive roller for driving the transfer belt. The photosensitive drums on which images in colors are to be formed are equipped with the gears which are attached to the central axes of the photosensitive drums. The gears are linked to the first motor by the timing belt via the idle gear. Meanwhile, the photosensitive drum on which the black image is to be formed is equipped with the gear which is attached to the central axis of the photosensitive drum. This gear is linked to the second motor via the idle gear. Further, the gear is attached to the central axis of the roller for driving the transfer belt, and linked also to the second motor via the idle gear. The gear is attached to the central axis of the fixing apparatus as well, and linked also to the second motor via the idle gear. In other words, in the conventional apparatus described above, each of the motors is linked to the plural rollers through drive transmission members such as gears, and functions as a common motor. Therefore, as described above, the common motors are disposed with their motor main sections protrude in the main scanning direction beyond the image forming stations, the transfer belt, etc. Further, it is possible to suppress the amount of this protrusion by means of improvement of the shape or the like of the toner replenishing containers. However, the size, the shape and the like of the common motors can not be changed if basic operation characteristics such as the torque and the rotation speed are to be satisfactory. This imposes a certain limitation upon reduction of the amount of this protrusion.

A first advantage of some aspects of the invention is downsizing of an image forming apparatus which comprises a common drive mechanism which transmits rotation drive force developing at a common motor to plural places in the respective sections of the apparatus.

A second advantage of some aspects of the invention is suppression of size expansion of an image forming apparatus which further comprises toner replenishing containers.

According to an aspect of the invention, an image forming apparatus comprising: a transfer unit which has a transfer medium moving along a predetermined travel direction; plural image forming stations which are disposed along the travel direction, each of the image forming stations including a latent image carrier which rotates in a sub scanning direction, an image writer which forms a latent image on the latent image carrier and a developer which has a toner carrier extending along a main scanning direction approximately perpendicular to the sub scanning direction and provides the latent image carrier with toner carried on the toner carrier, to thereby form a toner image; and a driver which drives respective sections of the apparatus so as to superimpose the plural toner images formed by the plural image forming stations one atop the other and form a color image onto the transfer medium, wherein each of the plural image writers includes a line head in which plural light emitting elements are arranged in a row along in the main scanning direction, the line head being disposed in the vicinity of the associated one of the latent image carriers and forming a latent image is formed on the latent image carrier, the driver includes a common drive mechanism which transmits rotation drive force developing at one common motor to plural places in the respective sections of the apparatus, and the common motor is disposed such that a motor main section of the common motor overlaps the transfer medium or the transfer unit in the in-plane arrangement viewed from the vertical direction perpendicular to both of the main scanning direction and the sub scanning direction.

In the structure according to the invention, although the motor main section (the rotor, the stator and the case which house the both) of the common motor is inevitably large as the driver comprises the common drive mechanism which transmits the rotation drive force developing at one common motor to plural places in the respective sections of the apparatus, downsizing of the apparatus is possible with the common motor arranged in the following manner. That is, the common motor is disposed such that the motor main section overlaps the transfer medium in the in-plane arrangement viewed from the vertical direction which is perpendicular to both of the main scanning direction and the sub scanning direction, which prevents the motor main section of the common motor from protruding in the main scanning direction beyond the image forming stations, the transfer medium and the like in the in-plane arrangement. This in turn makes it possible to realize downsizing of the apparatus despite the size expansion of the common motor. In the event that such an arrangement structure is used however, interference with the image writers which form the image forming stations becomes a problem. According to the invention however, the line heads forming the image writers are disposed in the vicinity of the latent image carriers and form latent images on the latent image carriers. Owing to this, as compared with a conventional apparatus which forms a line latent image while making light from a light emitting element scan, the image writers take up much less space. Hence, it is possible to dispose the motor main section in the accordingly unused space, thereby avoiding interference between the image writers and the motor main section even in the motor arrangement structure described above.

Alternatively, for each image forming station, a toner replenishing container may be disposed at the axial edge sections of the toner carrier to thereby supply toner to the associated developer. In this instance, each toner replenishing container may be disposed such that its entirety or a local part sticks out from the transfer medium in the in-plane arrangement.

In this structure according to the invention, it is the toner replenishing containers and the driver that mainly cause size expansion of the apparatus. Studying the toner replenishing containers of these, one can see the following. Each toner replenishing container is disposed such that its entirety or a local part projects beyond the transfer medium when viewed in the in-plane arrangement from the vertical direction which is perpendicular to the main scanning direction and the sub scanning direction. The amount of the projection therefore is the increase of the size of the apparatus. However, the fact that the principal purpose of the toner replenishing containers is temporary storage of supplementary toner allows a great flexibility in designing the shape, the toner storing capacity and the like of the toner replenishing containers, and hence, if the shape, the size and the like of the toner replenishing containers are improved, it is possible to suppress the amount of the projection and size expansion of the apparatus.

Meanwhile, as the driver comprises the common drive mechanism which transmits the rotation drive force developing at one common motor to plural places in the respective sections of the apparatus according to the invention, the motor main section (rotor, stator and case which house the both) of the common motor is inevitably large, which is a more serious problem with respect to size expansion of the apparatus than the problem attributable to the toner replenishing containers. To deal with this, the invention requires disposing the common motor such that the location of the motor main section overlaps that of the transfer medium in the in-plane arrangement, thereby preventing the motor main section of the common motor from sticking out beyond the image forming stations, the transfer medium and the like along the main scanning direction in the in-plane arrangement. In consequence, the larger size of the common motor does not increase the size of the apparatus, and a mere improvement of the shape and the like of the toner replenishing containers suppresses size expansion of the apparatus. Where such an arrangement structure is used however, interference with the image writers which form the image forming stations arises as a problem. The invention, noting this, requires disposing the line heads forming the image writers in the vicinity of the latent image carriers so that latent images are formed on the latent image carriers. Owing to this, as compared with a conventional apparatus which forms a line latent image while making light from a light emitting element scan, the image writers take up much less space. Hence, it is possible to dispose the motor main section in the accordingly unused space, thereby avoiding interference between the image writers and the motor main section even in the motor arrangement structure described above.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

First Embodiment

Figure 1:
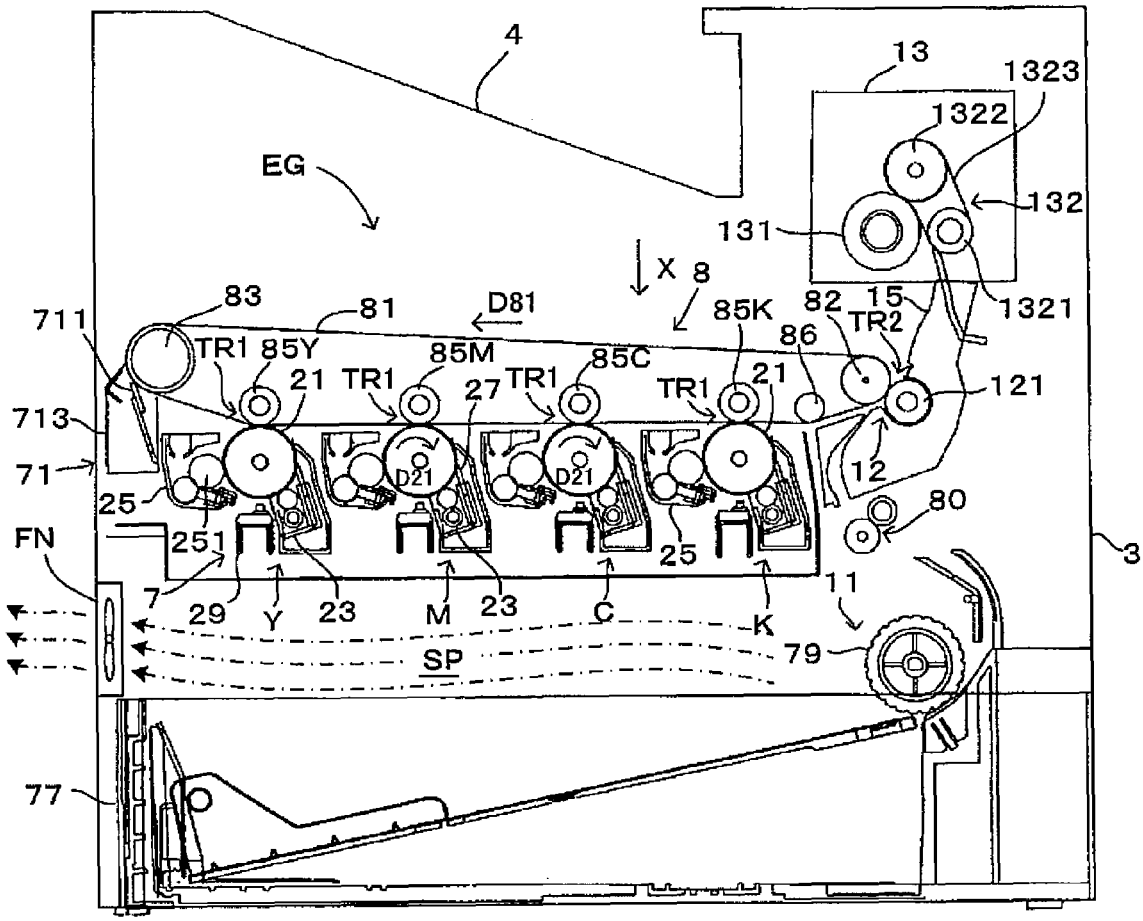
FIG. 1 is a drawing of an image forming apparatus according to an embodiment of the invention.
Figure 2:
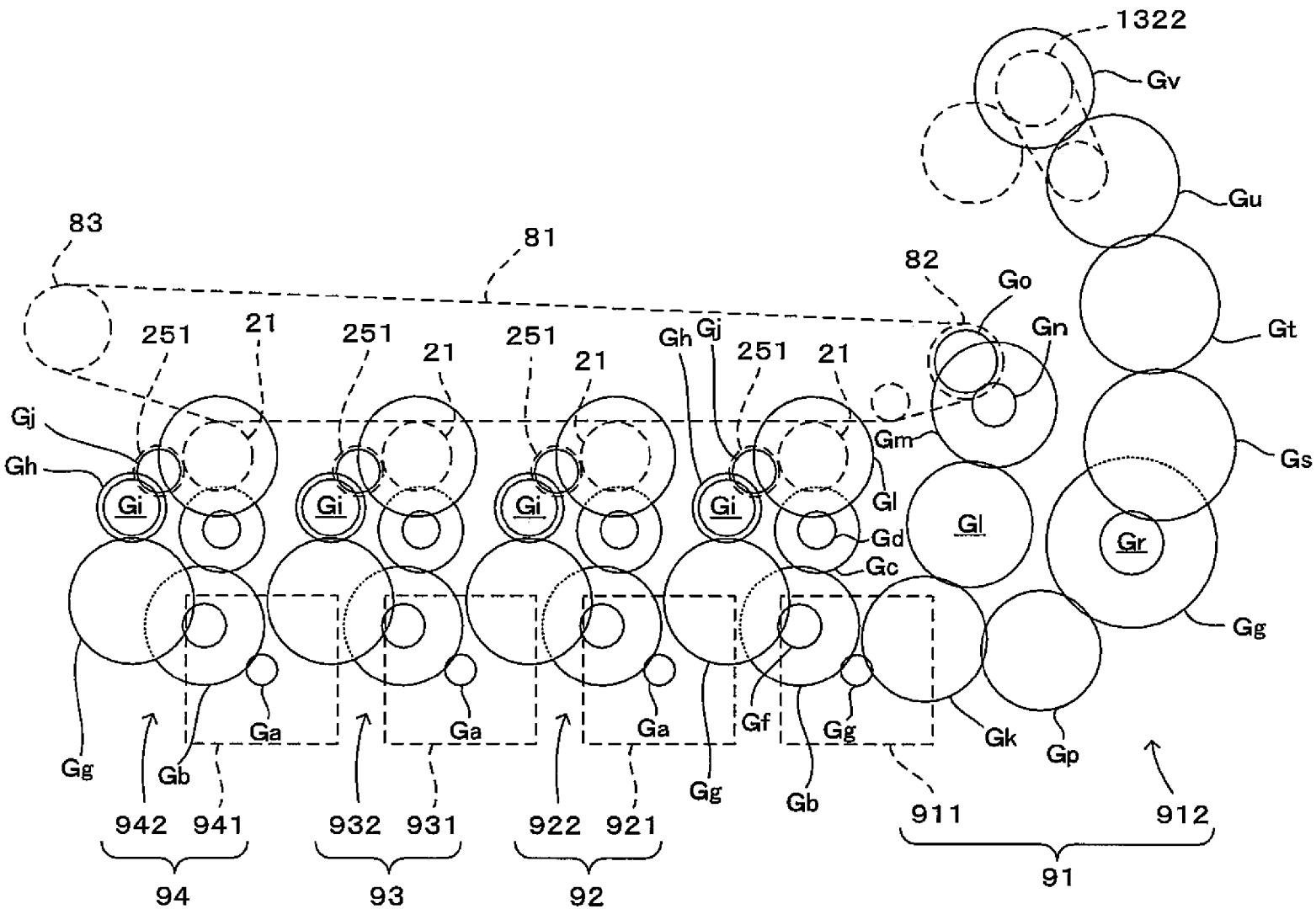
FIG. 2 is a drawing of a drive mechanism which drives each section of the image forming apparatus shown in FIG. 1.
Figure 3:
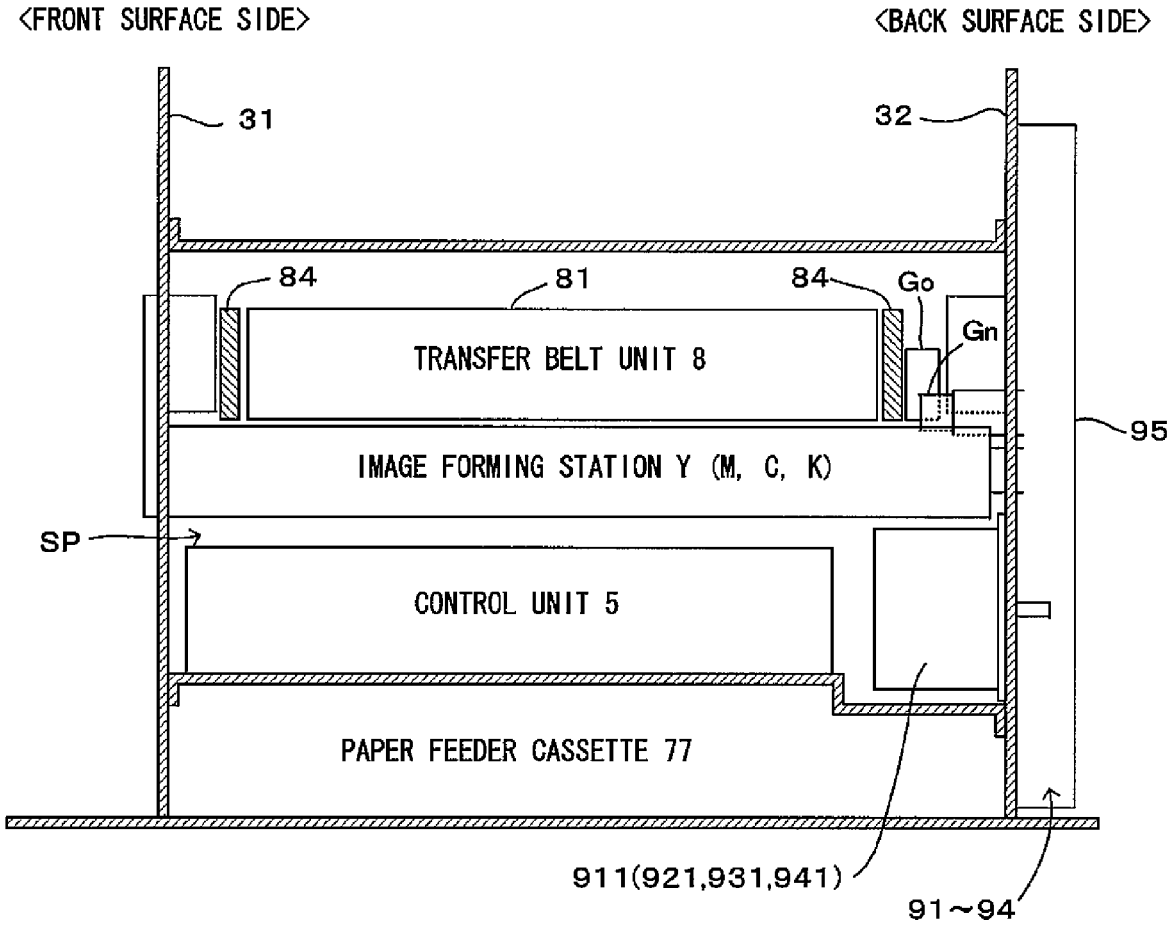
FIG. 3 is a partial cross sectional view of the image forming apparatus shown in FIG. 1.

FIG. 1 is a drawing of an image forming apparatus according to a first embodiment of the invention. FIG. 2 is a drawing of a drive mechanism which drives each section of the image forming apparatus shown in FIG. 1. FIG. 3 is a partial cross sectional view of the image forming apparatus shown in FIG. 1. This apparatus is an image forming apparatus which superimposes toner in four colors of black (K), cyan (C), magenta (M) and yellow (Y), one atop the other and forms a color image. In this image forming apparatus, as an image forming command is fed to a main controller from an external apparatus such as a host computer, an engine controller executes a predetermined image forming operation while controlling each portion of an engine section EG in accordance with this command received from the main controller. Hereby, an image which corresponds to the image forming command is formed on a sheet, a copy paper, a transfer paper, a general paper or a transparency for an overhead projector.

Inside a main housing section 3 of this image forming apparatus, there is a control unit (controller) 5, which incorporates a power source circuit board, the main controller and the engine controller and controls the respective sections of the apparatus, within an electric parts arranging space SP which will be described later. Disposed also inside the main housing section 3 are an image forming unit 7, a transfer belt unit (transfer unit) 8 and a paper feeder unit 11. Further, on the right-hand side inside the main housing section 3 in FIG. 1, a secondary transfer unit 12, a fixing unit 13 and a sheet guiding member 15 are disposed.

The image forming unit 7 comprises four image forming stations Y (yellow), C (cyan), M (magenta) and K (black) which form images in plural different colors. The respective image forming stations Y, M, C and K comprise photosensitive drums 21 whose surfaces will seat toner images in the respective colors. As shown in FIG. 3, paired support members 31 and 32, which are disposed at the both ends of the associated one of the image forming stations Y, M, C and K, axially support the associated photosensitive drum 21 so that the photosensitive drum 21 can freely revolve. Connected to a dedicated drive motor, each photosensitive drum 21 is driven into rotations at a predetermined speed along the direction denoted at the arrow D21 in the drawing. A detailed description will be given on the structure of the drive motors and the structure of a drive unit (driver) which provides the photosensitive drums 21 with rotation drive force developing at the respective drive motors and drive the photosensitive drums 21.

A charger 23, an image writer 29, a developer 25 and a photosensitive cleaner 27 are disposed around each photosensitive drum 21 along the direction in which the photosensitive drum 21 rotates. These functional parts perform a charging operation, a latent image forming operation and a toner developing operation. In FIG. 1, since the image forming stations of the image forming unit 7 are identical in structure, for the convenience of illustration, reference symbols are assigned only to some image forming stations but omitted on other image forming stations.

The charger 23 comprises a charging roller whose surface is made of elastic rubber. This charging roller is structured such that it abuts on the surface of the photosensitive drum 21 at a charging position and follows and rotates together with the photosensitive drum 21. As the photosensitive drum 21 rotates, the charging roller follows and rotates together with the photosensitive drum 21 at a circumferential velocity in a slave direction. In addition, this charging roller is connected with a charging bias generator (not shown). Upon being applied with a charging bias from the charging bias generator, the charging roller charges up the surface of the photosensitive drum 21 at the charging position where the charger 23 and the photosensitive drum 21 abut on each other.

The image writer 29 uses a line head in which light emitting elements are arranged in a row along the axial direction (which is the direction perpendicular to the plane of FIG. 1). The light emitting elements can be used organic EL (electroluminescence) devices, light emitting diodes or liquid crystal shutters equipped with backlights. The image writer 29 is disposed away from the photosensitive drum 21. Such light emitting elements irradiate light upon the surface of the photosensitive drum 21 thus charged up by the charger 23, whereby a latent image is formed on this surface. The line head has a shorter optical path than that of a laser scanning optical system and is smaller than the laser scanning optical system, which dramatically reduces the space occupied by the image writer 29. Further, since the image writer 29 can be disposed in the vicinity of the photosensitive drum 21, the space occupied by the image writer 29 is located close to the latent image carrier. This eliminates the necessity of the space which has heretofore been essential to a conventional image writer of the laser scanning type, and creates a relatively wide space immediately below the image forming unit 7 as shown in FIGS. 1 and 3. In this embodiment, the space SP surrounded by the paired support members 31 and 32 and the image forming stations Y, M, C and K can therefore be created on the opposite side of the transfer belt unit 8 relative to the image forming stations Y, M, C and K (i.e., on the lower side in the drawings). This space SP will be hereinafter referred to as the "electric parts arranging space".

Further, in this embodiment, an exhaust fan FN facing the electric parts arranging space SP is disposed to the left-hand side surface of a main apparatus section (i.e., the left-hand side surface in FIG. 1). The exhaust fan FN creates air flows denoted at the dashed-and-dotted lines in FIG. 1 within the electric parts arranging space SP. The air flows therefore exhaust the apparatus, and particularly the electric parts arranging space SP, of heat staying inside the apparatus and the electric parts arranging space SP, whereby a temperature increase inside the apparatus is suppressed. In this embodiment, the exhaust fan FN thus functions as the "exhaust element" of the invention.

In this embodiment, the photosensitive drum 21, the charger 23, the image writer 29, the developer 25 and the photosensitive cleaner 27 of each one of the respective image forming stations Y, M, C and K are unitized as a photosensitive cartridge (not shown).

The developer 25 comprises a developing roller (toner carrier) 251 whose surface carries toner and which is shaped like a cylindrical column extending along the main scanning direction. This developing roller 251 is disposed so that it can freely rotate within the photosensitive cartridge, and rotates upon applying rotation drive force from the drive motor corresponding to this cartridge. In other words, according to this embodiment, for each color, rotation drive force developing at one drive motor is supplied to the photosensitive drums 21 and the developing rollers 251 via a drive mechanism, and the drive motors correspond to the "common motors" of the invention. This will also be described in detail later.

A developing bias generator (not shown) is electrically connected with the developing roller 251 which rotates while carrying toner. As a developing bias is applied upon the developing roller 251, charged toner moves from the developing roller 251 to the photosensitive drum 21 at a development position where the developing roller 251 and the photosensitive drum 21 abut on each other. Hence, an electrostatic latent image formed by the image writer 29 is visualized.

After transported in the rotation direction D21 of the photosensitive drum 21, the toner image visualized at the development position is primarily transferred onto a transfer belt 81, which will be described in detail later, at a primary transfer position TR1 where the transfer belt 81 and the photosensitive drum 21 abut on each other.

Further, in this embodiment, the photosensitive cleaner 27 is located on the downstream side to the primary transfer position TR1 along the rotation direction D21 of the photosensitive drum 21 and the upstream side to the charger 23. Abutting on the surface of the photosensitive drum 27, the photosensitive cleaner 27 removes toner remaining on the surface of the photosensitive drum and cleans this surface after primary transfer.

The transfer belt unit 8 comprises paired transfer unit frames 84 and 84 which axially support a drive roller 82 and a follower roller (blade-facing roller) 83 which is disposed on the left-hand side to the drive roller 82 in FIG. 1 so that the drive roller 82 and the follower roller 83 can freely rotate. Of these rollers, the drive roller 82 rotates subjected to the rotation drive force from the drive motor which is disposed for the black image forming station K. In short, in this embodiment, the black drive motor corresponds to the "common motor" of the invention. The transfer belt 81 stretches about these rollers, and therefore, as the drive roller 82 rotates exposed to the rotation drive force from the black drive motor, the transfer belt 81 rotates in cycles along the direction denoted at the arrow D81 in the drawing (i.e., transportation direction).

In addition, the transfer belt unit 8 comprises four primary transfer rollers 85Y, 85M, 85C and 85K (transfer members). Each of the rollers comes opposed against the photosensitive drum 21 of the associated one of the image forming stations Y, M, C and K when the associated photosensitive cartridge is set, inside the transfer belt 81. These primary transfer rollers 85 are positioned respectively on the associated image forming stations Y, M, C and K, the transfer belt 81 is pushed against and abutted on the photosensitive drums 21 of the image forming stations Y, M, C and K. This creates the primary transfer positions TR1 between the respective photosensitive drums 21 and the transfer belt 81. Further, the primary transfer rollers 85 are electrically connected with a primary transfer bias generator (not shown). As these primary transfer rollers 85 abut on the respective photosensitive drums 21 via the transfer belt 81 and the primary transfer bias generator applies a primary transfer bias at appropriate timing. This makes the toner images on the surfaces of the photosensitive drums 21 transferred onto the transfer belt 81 at the primary transfer positions TR1 where the respective photosensitive drums 21 and the transfer belt 81 abut on each other.

The transfer belt unit 8 further comprises a guide roller 86 (downstream guide roller) which is disposed on the downstream side to the primary transfer roller 85K (downstream-most transfer member) on the upstream side to the drive roller 82. The roller 85 is the downstream-most one of the four primary transfer rollers 85Y, 85M, 85C and 85K along the transportation direction D81. The guide roller 86 is structured such that it abuts on the transfer belt 81, on a common inscribed line between the primary transfer roller 85K and the photosensitive drum 21 at the primary transfer position TR1 which is created as the primary transfer roller 85K abuts on the photosensitive drum 21 of the image forming station K.

The drive roller 82 drives the transfer belt 81 into cyclic rotations along the transportation direction D81 in the drawing, and also serves as a backup roller for a secondary transfer roller 121. The circumferential surface of the drive roller 82 seats a rubber layer whose thickness is about 3 mm and whose volume resistivity is 1000 k Ω·cm or less. Grounding via a metallic shaft establishes a conductive path for a secondary transfer bias which is fed via the secondary transfer roller 121 from a secondary transfer bias generator not shown. The drive roller 82 has the rubber layer which is highly resistive and absorbs an impact. Therefore, an impact developing upon entry of a sheet to an abutting area (secondary transfer position TR2) between the drive roller 82 and the secondary transfer roller 121 does not easily reach the transfer belt 81, which makes it possible to prevent an image degradation.

The paper feeder unit 11 comprises a paper feeder. The feeder includes a paper feeder cassette 77, which is capable of holding a stack of sheets which correspond to the "recording member(s)" of the invention, and a pick-up roller 79 which feeds the sheets one by one from the paper feeder cassette 77. The sheet fed by the pick-up roller 79 from the paper feeder cassette 77, after adjusted as for its paper feeding timing by paired resist rollers 80, arrives at the secondary transfer position TR2 along a sheet guiding member 15.

The secondary transfer roller 121 is disposed so that it can freely abut on and move away from the transfer belt 81. Upon being driven by a secondary transfer roller drive mechanism (not shown), the secondary transfer roller 121 abuts on and moves away from the transfer belt. The fixing unit 13 comprises a heat roller 131, which incorporates a heating element such as a halogen heater and can freely rotate, and a pressurizing section 132 which presses the heat roller 131. The sheet guiding member 15 guides the sheet now seating on its surface the secondarily transferred image to a nip area which is created by the heat roller 131 and a pressurizing belt 1323 of the pressurizing section 132, and the image is heat-fixed at a predetermined temperature in the nip area. The pressurizing section 132 is formed by two rollers 1321 and 1322 and the pressurizing belt 1323 stretching about these rollers. As a tense belt surface between the two rollers 1321 and 1322 within the surface of the pressurizing belt 1323 is pressed against the circumferential surface of the heat roller 131, the heat roller 131 and the pressurizing belt 1323 create a wide nip area. Further, according to this embodiment, the paired support members 31 and 32 axially support the roller 1322 such that the roller 1322 can freely rotate, and like the drive roller 82. Upon being applied to the rotation drive force from the drive motor which is disposed for the black image forming station K, the roller 1322 rotates and drives the pressurizing belt 1323 into cyclic rotations. The sheet thus subjected to fixing is conveyed to a discharge tray 4 which is disposed in an upper portion of the main housing section 3.

Further, a cleaner 71 is disposed opposed against the blade-facing roller 83 within this apparatus. The cleaner 71 comprises a cleaner blade 711 and a waste toner box 713. As a front edge portion of the cleaner blade 711 abuts on the blade-facing roller 83 via the transfer belt 81, foreign matters such as paper dust and toner on the transfer belt which remain residual even after secondary transfer are removed. Thus removed foreign matters are collected by the waste toner box 713. The cleaner blade 711 and the waste toner box 713 are formed integrated with the blade-facing roller 83.

Figure 4:
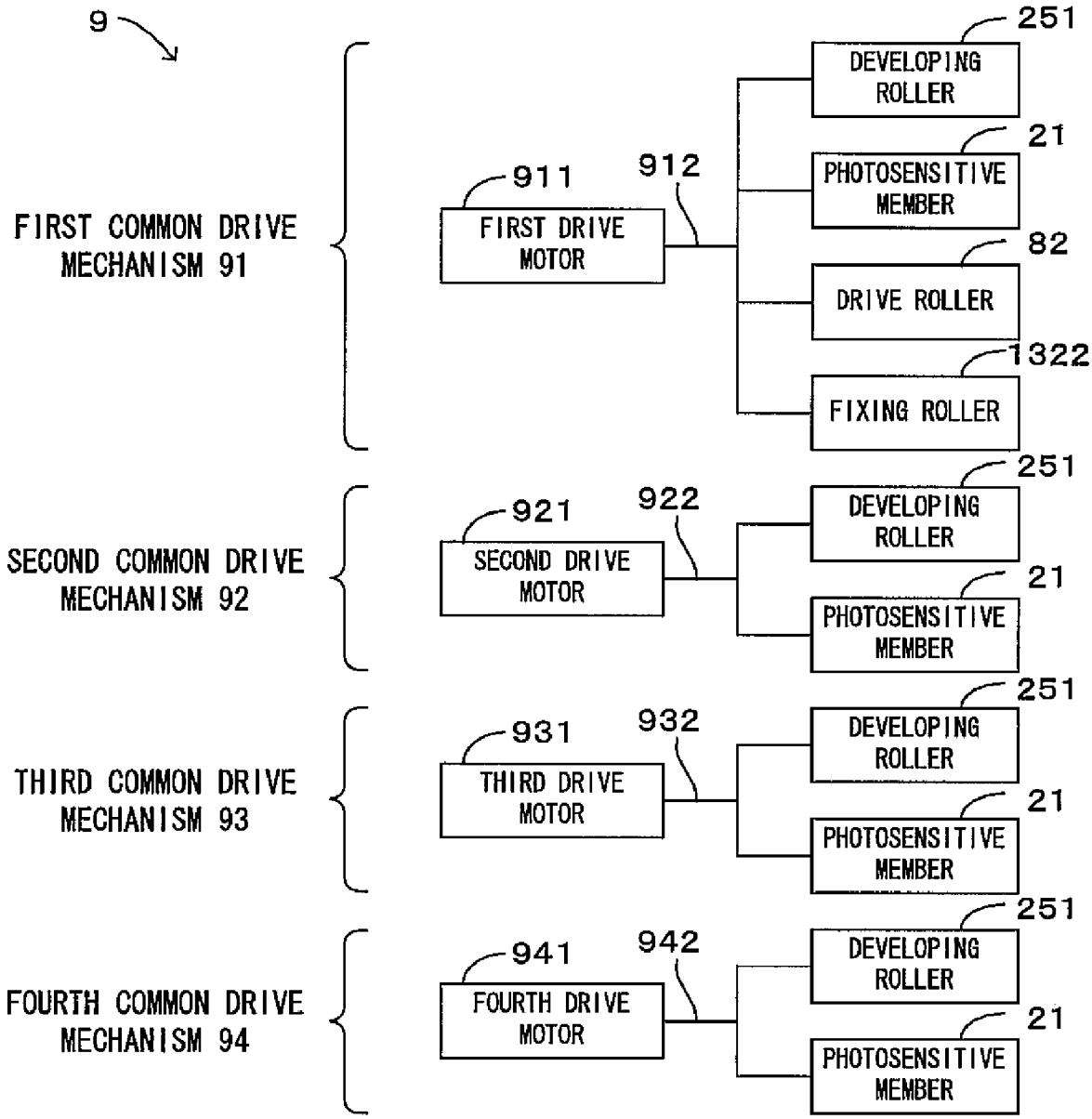
FIG. 4 is a block diagram which shows a principal structure of a drive unit which drives the respective sections of the apparatus.

FIG. 4 is a block diagram which shows a principal structure of the drive unit which drives the respective sections of the apparatus. The structure and the operation of the drive unit will now be described with reference to FIGS. 1 to 4. This drive unit 9 comprises four common drive mechanisms 91 through 94 in order to drive the photosensitive drums 21, the developing rollers 251, the drive roller 82 and the fixing roller 1322. In short, the first common drive mechanism 91 comprises a first drive motor 911 and a first drive transmission section 912. The mechanism 91 transmits rotation drive force developing at the first drive motor 911 to the black photosensitive drum 21, the black developing roller 251, the drive roller 82 and the fixing roller 1322 via the first drive transmission section 912 and drives these elements. As shown in FIG. 2, the first drive transmission section 912 is formed by 22 gears Ga through Gv in total, including the pinion gear Ga which is fixed to a rotation shaft of the first drive motor 911. Of these gears, the gears Ga through Ge form a grea train for driving the photosensitive member. This photosensitive member drive grea train transmits the rotation drive force developing at the first drive motor 911 to the gear Ge fixed to a rotation shaft of the black photosensitive drum 21, thereby driving this photosensitive drum 21. Meanwhile, the gears Ga, Gb and Gf to Gj form a fear train for driving the developer. This development drive gear train transmits the rotation drive force developing at the first drive motor 911 to the gear Gj which is fixed to a rotation shaft of the black developing roller 251, thereby driving this developing roller 251. The gears Ga and Gk through Go form a gear train for driving the transfer belt 81. This transfer drive gear train transmits the rotation drive force developing at the first drive motor 911 to the gear Go which is fixed to a rotation shaft of the drive roller 82, whereby the drive roller 82 is driven and the transfer belt 81 circulates along the transportation direction D81. Further, the gears Ga, Gk and Gp to Gv form a gear train for driving the fixing unit. This fixing drive gear train transmits the rotation drive force developing at the first drive motor 911 to the gear Gv which is fixed to a rotation shaft of the fixing roller 1322, thereby driving the fixing roller 1322.

The second common drive mechanism 92 comprises a second drive motor 921 and a second drive transmission section 922. The mechanism 92 transmits rotation drive force developing at the second drive motor 921 to the cyan photosensitive drum 21 and the cyan developing roller 251 via the second drive transmission section 922, driving these elements. The third common drive mechanism 93 comprises a third drive motor 931 and a third drive transmission section 932. The mechanism 93 transmits rotation drive force developing at the third drive motor 931 to the magenta photosensitive drum 21 and the magenta developing roller 251 via the third drive transmission section 932, driving these elements. The fourth common drive mechanism 94 comprises a fourth drive motor 941 and a fourth drive transmission section 942. The mechanism 94 transmits rotation drive force developing at the fourth drive motor 941 to the yellow photosensitive drum 21 and the yellow developing roller 251 via the fourth drive transmission section 942, driving these elements. The second through the fourth drive transmission sections 922 through 924 all have the identical structures as those of the photosensitive member drive gear train and the development drive gear train of the first drive transmission section 921.

As described above, in this embodiment, each one of the four drive motors 911, 921, 931 and 941 is linked to the plural driven elements (the roller, the photosensitive drum, etc.) via the drive gear trains and functions as the "common motor" of the invention. This puts a relatively great load upon these drive motors 911, 921, 931 and 941, and therefore, the motor main sections (rotors, stators and cases which house the both) of the respective drive motors 911, 921, 931 and 941 are inevitably big. However, the image writers 29 are comprised of the line heads formed by the plural light emitting elements according to this embodiment. This ensures the large electric parts arranging space SP which is a space immediately below the image forming unit 7 and permits disposing the motor main sections inside this electric parts arranging space SP. That is, as shown in FIG. 3, the space SP is formed so as to be surrounded by the paired support members 31 and 32 and the image forming stations Y, M, C and K according to this embodiment. The respective drive motors 911, 921, 931 and 941 are attached to the support member 32 which is located at the back side of the main apparatus section 1 (i.e., the right-hand side surface in FIG. 3) so that their motor main sections overlap the transfer belt 81 in the in-plane arrangement viewed from the vertical direction which is perpendicular to the main scanning direction and the sub scanning direction (i.e., the top-bottom direction in FIG. 3) inside the electric parts arranging space SP. Further, the gears forming the drive transmission sections 912, 922, 932 and 942 are disposed inside a drive box 95 on the back side of the support member 32. This prevents the motor main sections from protruding beyond the image forming stations Y, M, C and K, the transfer belt 81 and the like in the in-plane arrangement along the main scanning direction (which is the right-left direction in FIG. 3). As a result, it is possible to reduce the size of the apparatus along the main scanning direction despite the size expansion of the first through the fourth drive motors 911, 921, 931 and 941.

In addition, the arrangement described above of the motor main sections inside the electric parts arranging space SP suppresses leakage to outside the apparatus of sounds created by the respective drive motors 911, 921, 931 and 941 and reduces noises associated with the apparatus. Further, since the exhaust fan FN discharges exhaust air from the electric parts arranging space SP, heat developing at the motor main sections of the respective drive motors 911, 921, 931 and 941, the control unit 5 and the like is discharged efficiently to outside the apparatus. It is therefore possible to suppress an increase of the internal temperature of the apparatus and stabilize the operations of the apparatus.

Second Embodiment

By the way, separately disposed toner replenishing containers have been proposed in an attempt to reduce the amount of toner housed in developer main sections of a developer unit. A technique for suppressing size expansion of an image forming apparatus of this type is also in demand. The second embodiment of the invention will now be described with reference to FIGS. 5 through 7.

Figure 5:
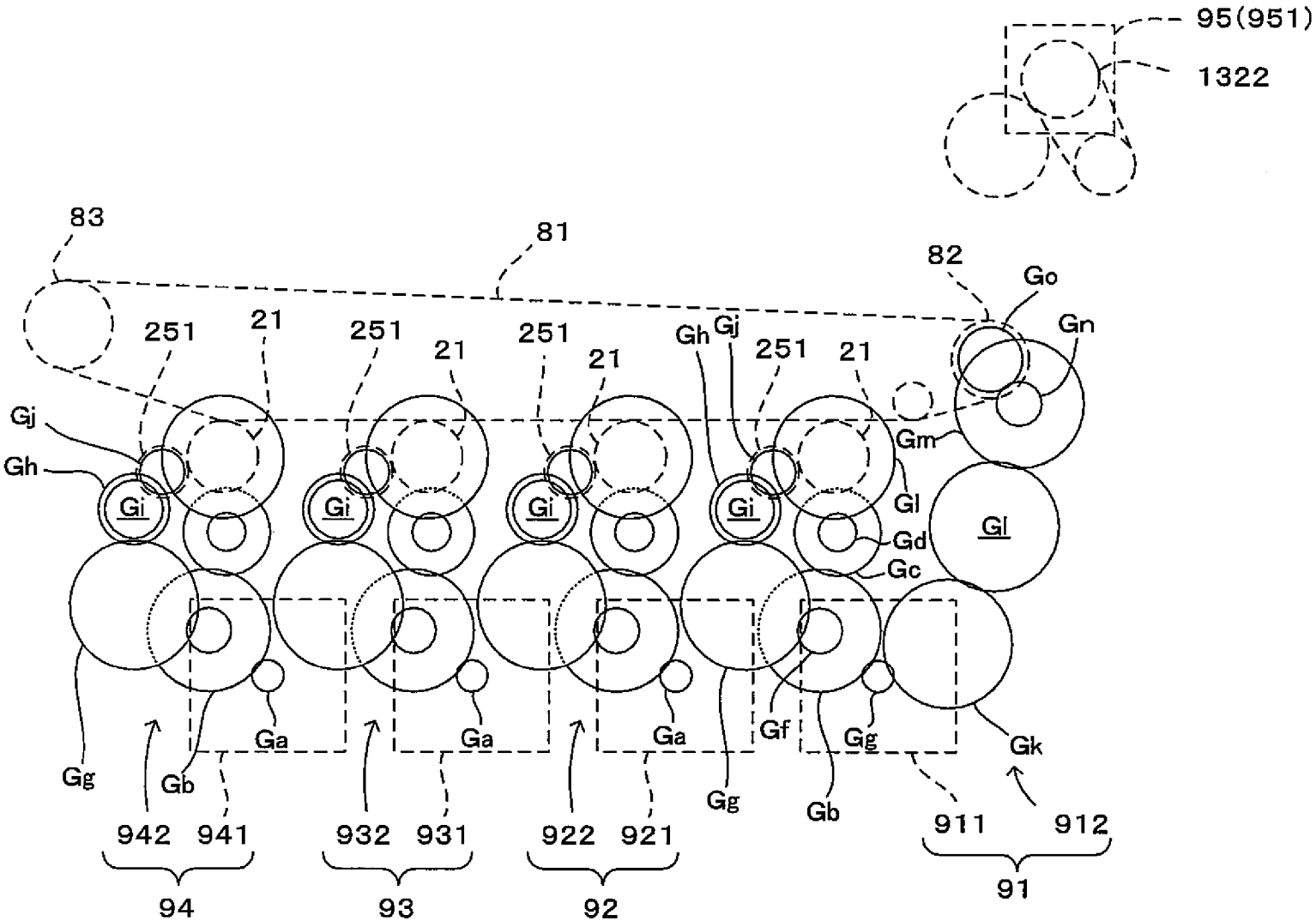
FIG. 5 is a drawing which shows a drive structure for driving the respective sections of an image forming apparatus according to a second embodiment.
Figure 6:
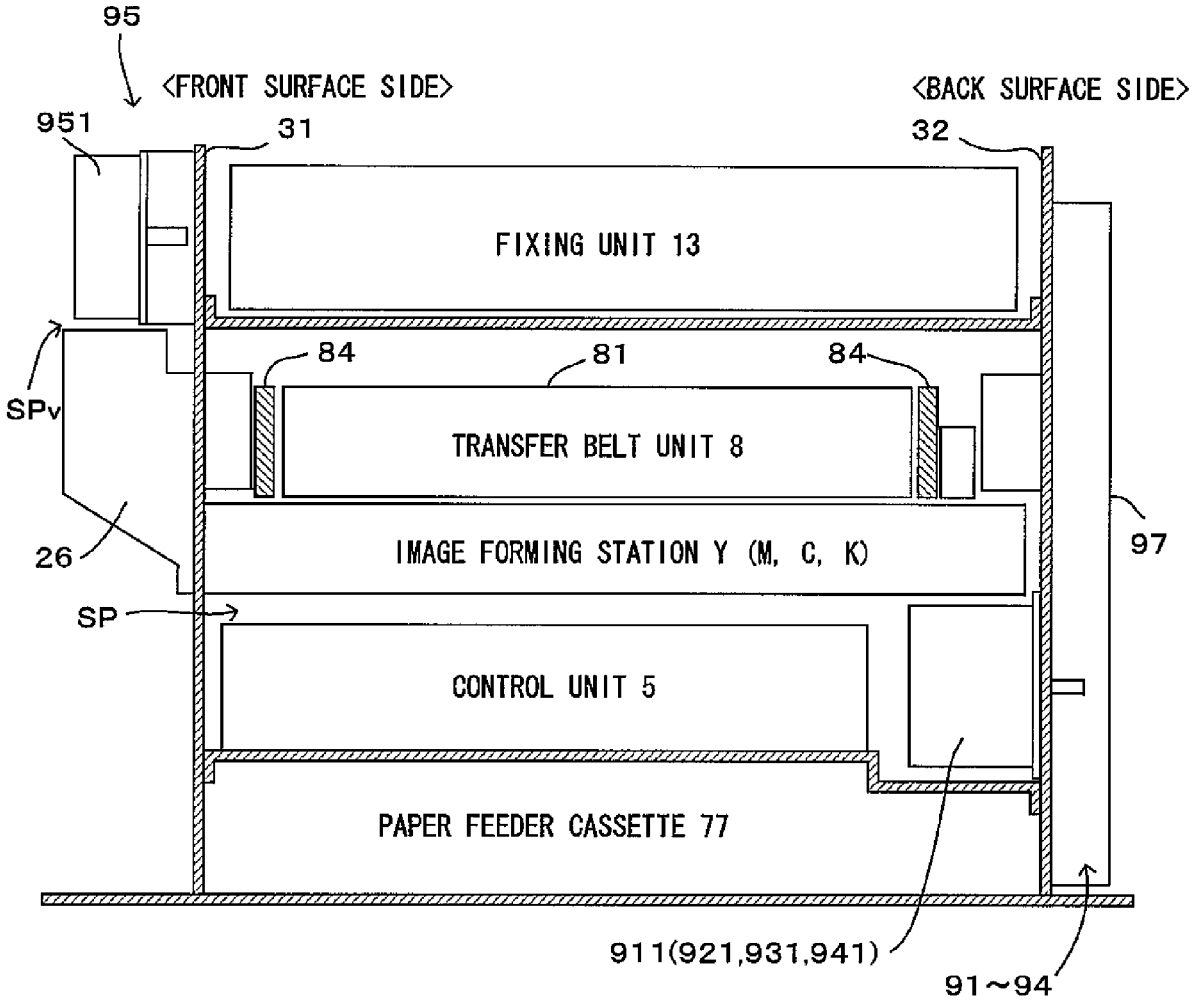
FIG. 6 is a partial cross sectional view of the image forming apparatus according to the second embodiment.

FIG. 5 is a drawing which shows a drive structure for driving the respective sections of an image forming apparatus according to the second embodiment. FIG. 6 is a partial cross sectional view of the image forming apparatus according to the second embodiment. This apparatus is an image forming apparatus which superimposes toner in four colors of black (K), cyan (C), magenta (M) and yellow (Y) one atop the other and forms a color image. In this image forming apparatus, as an image forming command is fed to a main controller from an external apparatus such as a host computer, an engine controller executes a predetermined image forming operation while controlling each portion of an engine section EG in accordance with this command received from the main controller, whereby an image which corresponds to the image forming command is formed on a sheet which may be a copy paper, a transfer paper, a general paper or a transparency for an overhead projector. In the following, a structure according to the second embodiment common to that according to the first embodiment will be denoted at the same reference symbols but will not be described in redundancy. Instead, differences will be described in detail with reference to the drawings.

According to this embodiment, as shown in FIG. 6, a toner replenishing container 26 is disposed on the front surface side of the apparatus (i.e., the left-hand side surface in FIG. 6) so that it can be freely attached to and detached from the developer 25 of the image forming unit. In short, upon being mounted to the developer 25, the toner replenishing container 26 comes located at the end of the rotation shaft of the developing roller 251, namely, an axial edge portion. Hence toner stored inside the container can be supplied to the inside of the developer 25 as needed. Further, a part of the toner replenishing container 26 sticks out to the front surface side beyond the image forming stations Y, M, C and K and the transfer belt unit 8 in the in-plane arrangement viewed from the vertical direction X (FIG. 1) which is approximately perpendicular to the main scanning direction and the sub scanning direction. This allows a user hold the projecting portion and easily detach the toner replenishing container 26 off from the developer 25. This similarly applies to where the toner replenishing container 26 needs be mounted to the developer 25 after filling the toner replenishing container 26 with toner. The toner replenishing container 26 is thus located at the axial edge portion of the developing roller 251. In the apparatus having such a structure therefore, a user can access the toner replenishing container from the front surface side of the apparatus, which attains excellent maintainability.

Figure 7:
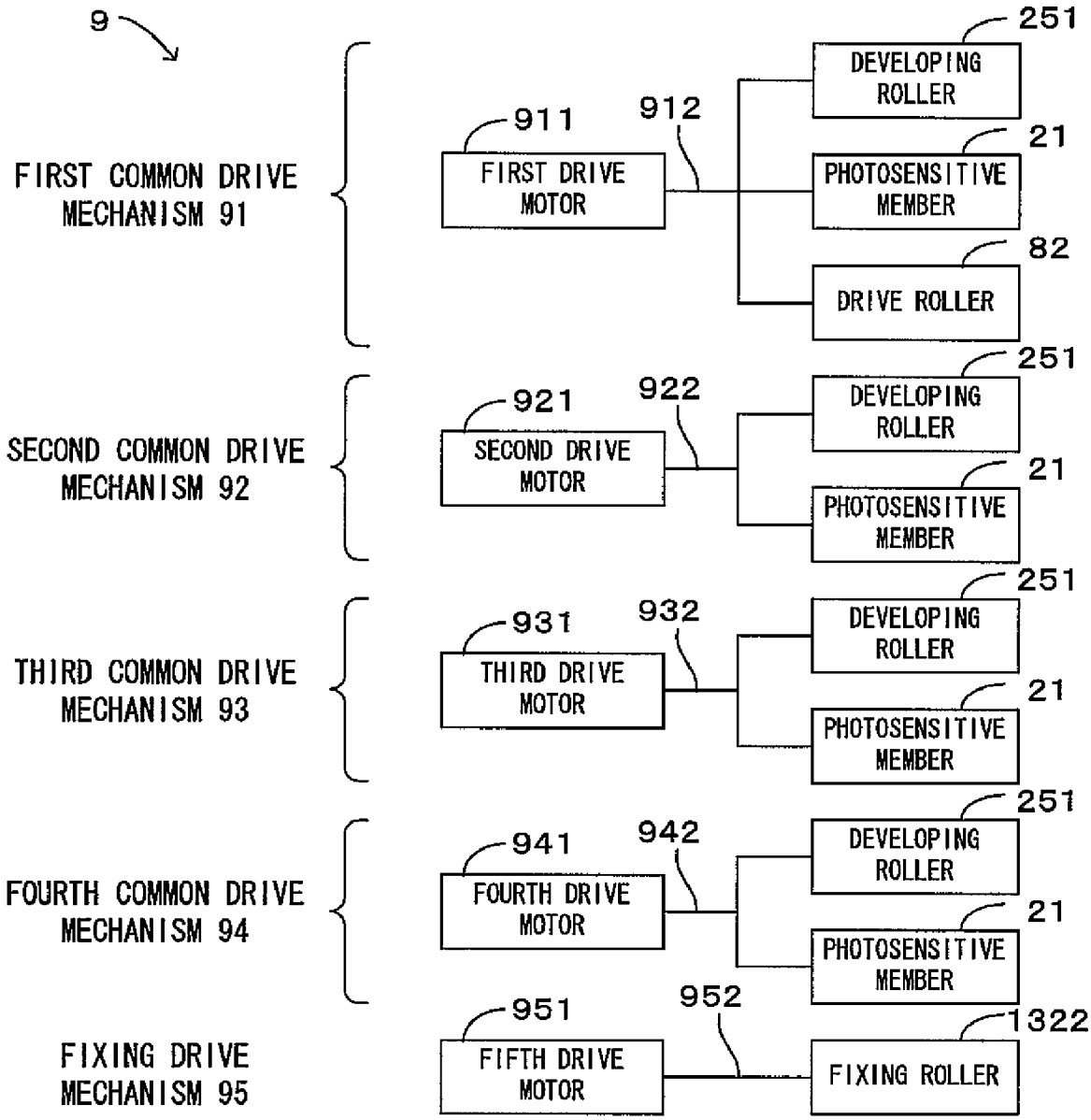
FIG. 7 is a block diagram which shows a principal structure of a drive unit which drives the respective sections of the apparatus according to the second embodiment.

FIG. 7 is a block diagram which shows a principal structure of the drive unit which drives the respective sections of the apparatus. The structure and the operation of the drive unit will now be described with reference to FIGS. 1 and 5 through 7. This drive unit 9 comprises four common drive mechanisms 91 through 94 in order to drive the photosensitive drums 21, the developing rollers 251 and the drive roller 82, and further, one fixing drive mechanism 95 in order to drive the fixing roller 1322. In short, the first common drive mechanism 91 comprises a first drive motor 911 and a first drive transmission section 912. The drive mechanism 91 transmits rotation drive force developing at the first drive motor 911 to the black photosensitive drum 21, the black developing roller 251 and the drive roller 82 via the first drive transmission section 912 and drives these elements. As shown in FIG. 5, the first drive transmission section 912 is formed by 15 gears Ga through Go in total, including the pinion gear Ga which is fixed to the rotation shaft of the first drive motor 911. Of these gears, the gears Ga through Ge form a drive gear train for driving the photosensitive member. This photosensitive member drive gear train transmits the rotation drive force developing at the first drive motor 911 to the gear Ge fixed to the rotation shaft of the black photosensitive drum 21, thereby driving this photosensitive drum 21. Meanwhile, the gears Ga, Gb and Gf to Gj form a drive gear train for driving the developer. This development drive gear train transmits the rotation drive force developing at the first drive motor 911 to the gear Gj which is fixed to the rotation shaft of the black developing roller 251, thereby driving this developing roller 251. The gears Ga and Gk through Go form a drive gear train for driving the transfer belt 81. This transfer drive gear train transmits the rotation drive force developing at the first drive motor 911 to the gear Go which is fixed to the rotation shaft of the drive roller 82, whereby the drive roller 82 is driven and the transfer belt 81 circulates along the transportation direction D81.

The fixing drive mechanism 95 comprises a fifth drive motor 951 and a fifth drive transmission section 952 which may be a coupling. The drive mechanism 95 transmits rotation drive force developing at the fifth drive motor 951 to the fixing roller 1322 via the fifth drive transmission section 952, thereby driving the drives the fixing roller 1322. In this embodiment, the fifth drive motor 951 thus functions as the "dedicated motor" of the invention.

As described above, according to this embodiment, each one of the four drive motors 911, 921, 931 and 941 is linked to the plural driven elements (the roller, the photosensitive drum, etc.) via the drive gear trains and functions as the "common motor" of the invention. This puts a relatively great load upon these drive motors 911, 921, 931 and 941, and therefore, the motor main sections (rotors, stators and cases which house the both) of the respective drive motors 911, 921, 931 and 941 are inevitably big. However, the image writers 29 are comprised of line heads formed by plural light emitting elements according to this embodiment, which ensures the large electric parts arranging space SP which is a space immediately below the image forming unit 7 and permits disposing the motor main sections inside this electric parts arranging space SP. That is, as shown in FIG. 6, the respective drive motors 911, 921, 931 and 941 are attached to the support member 32 which is located at the back side of the main apparatus section 1 (i.e., the right-hand side surface in FIG. 6) so that their motor main sections overlap the transfer belt 81 in the in-plane arrangement viewed from the vertical direction which is perpendicular to the main scanning direction and the sub scanning direction (i.e., the top-bottom direction in FIG. 6) inside the electric parts arranging space SP which is surrounded by the paired support members 31 and 32 and the image forming stations Y, M, C and K according to this embodiment. Further, the gears forming the drive transmission sections 912, 922, 932 and 942 are disposed inside a drive box 97 on the back side of the support member 32. This prevents the motor main sections from protruding beyond the image forming stations Y, M, C and K, the transfer belt 81 and the like in the in-plane arrangement along the main scanning direction (which is the right-left direction in FIG. 6). The common motors thus disposed therefore do not enlarge the apparatus despite the size expansion of the first through the fourth drive motors 911, 921, 931 and 941, which suppresses size expansion of the apparatus.

Meanwhile, the toner replenishing container 26 projects beyond the transfer belt 81 in the in-plane arrangement, as shown in FIG. 6. Although this creates a space SPv in the vertical direction of the projecting portion, the dedicated motors 251 are arranged overlapping the toner replenishing containers 26 in the in-plane arrangement. That is, in this embodiment, the fixing drive mechanism 95 for driving the fixing roller 1322 is disposed inside this vertical space SPv. This realizes an effective use of the vertical space SPv and makes the apparatus compact.

Further, since the motor main sections are disposed inside the electric parts arranging space SP as described above, it is possible to suppress leakage to outside the apparatus of sounds created by the respective drive motors 911, 921, 931 and 941 and reduces noises associated with the apparatus. Moreover, since the exhaust fan FN discharges exhaust air from the electric parts arranging space SP, heat developing at the motor main sections of the respective drive motors 911, 921, 931 and 941, the control unit 5 and the like is discharged efficiently to outside the apparatus. It is therefore possible to suppress an increase of the internal temperature of the apparatus and stabilize the operations of the apparatus.

Figure 8:
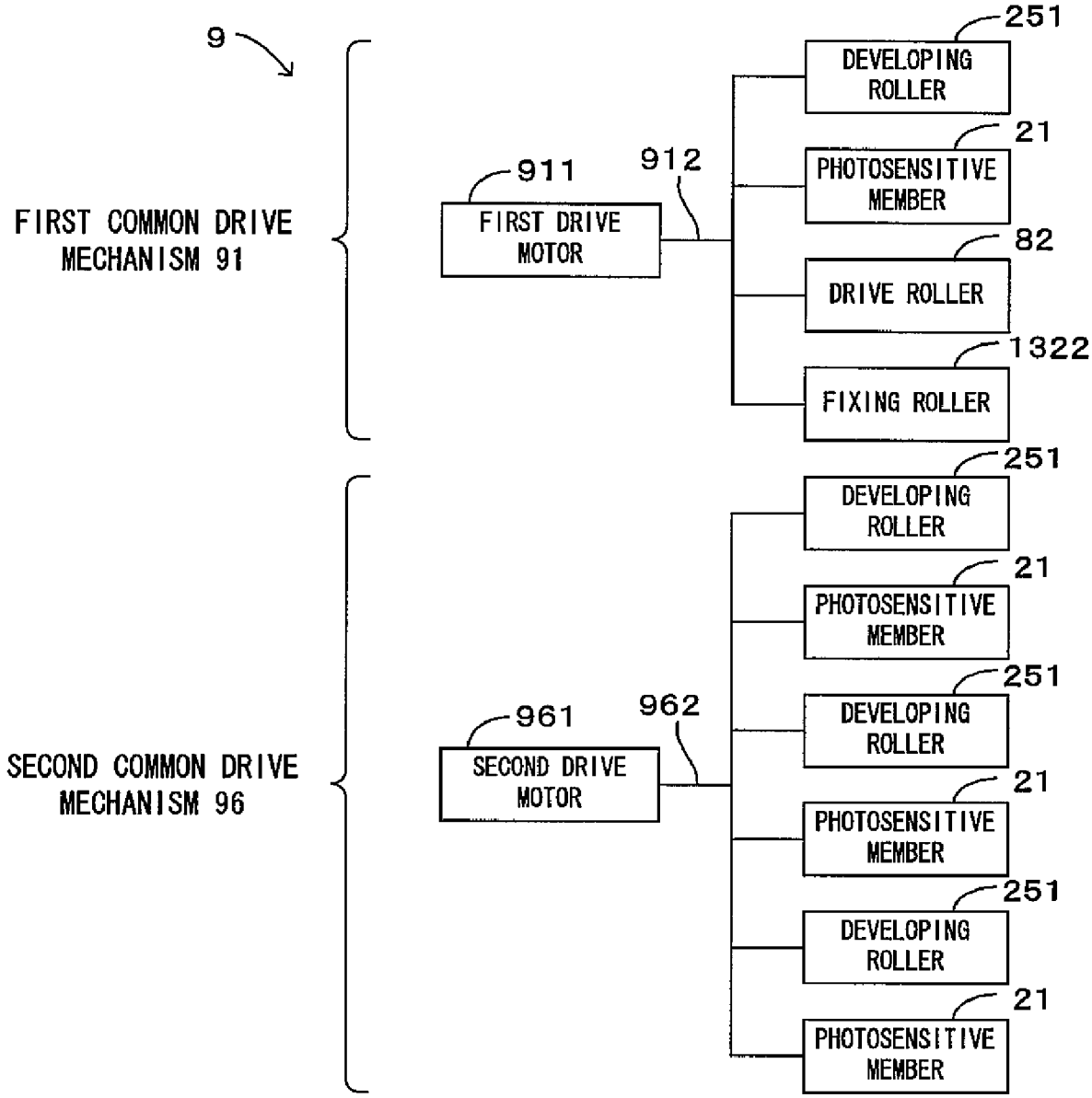
FIG. 8 is a block diagram which shows a principal structure of a drive unit which drives the respective sections of the apparatus according to another embodiment.
Figure 9:
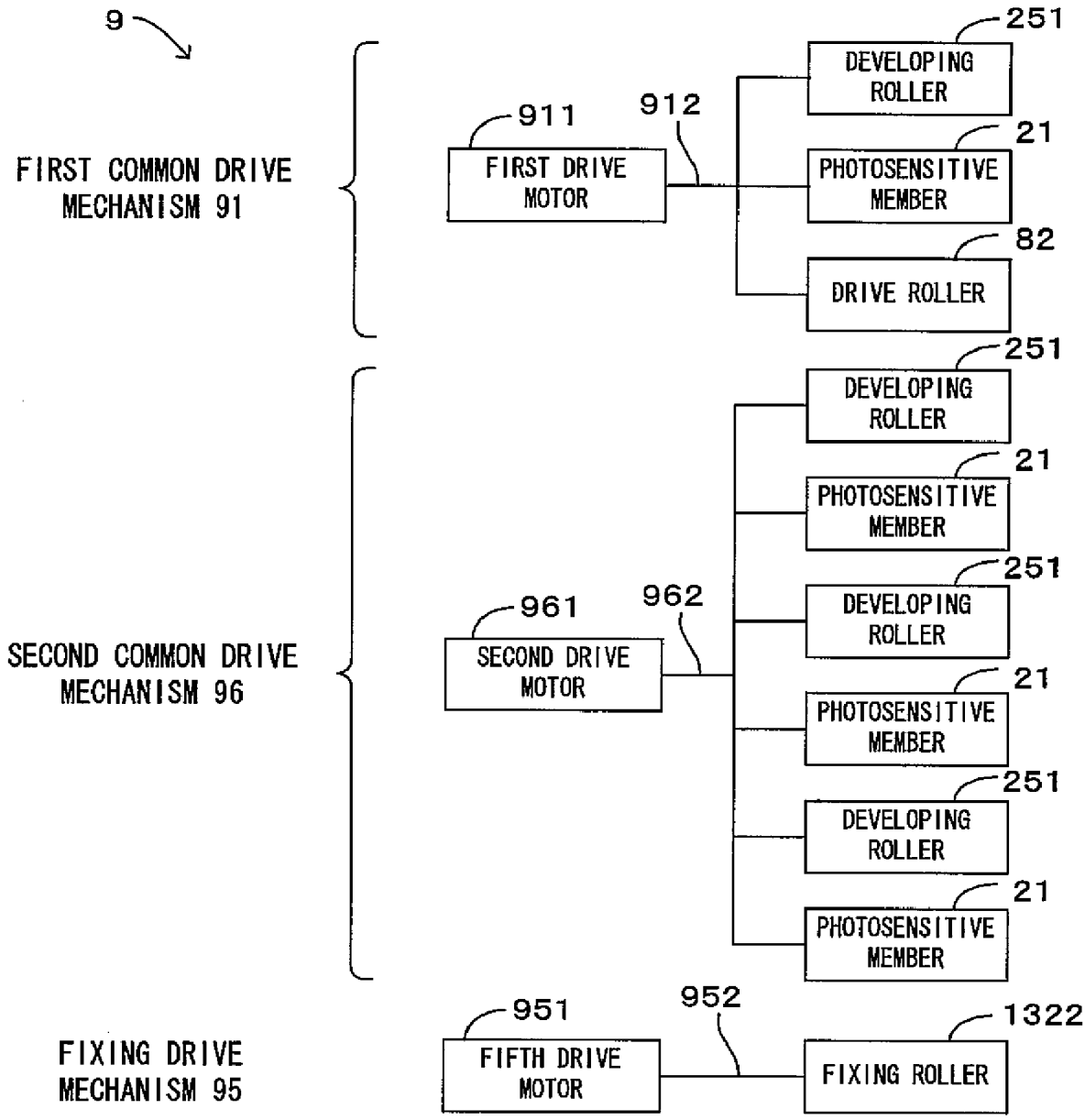
FIG. 9 is a block diagram which shows a principal structure of a drive unit which drives the respective sections of the apparatus according to a further embodiment.

The invention is not limited to the embodiment above, but may be modified in various manners in addition to the preferred embodiments above, to the extent not deviating from the object of the invention. For instance, although the embodiments above are directed to the application of the invention to an image forming apparatus in which the common drive mechanisms 92 through 94 are disposed for the respective colors, this is not the only application of the invention. The invention is generally applicable to any image creating apparatus which drives plural rollers with one common motor and forms an image. When the invention is applied to an image forming apparatus which comprises one common drive mechanism 96 for driving the photosensitive drum 21 and the developing roller 251 for yellow, magenta and cyan as shown in FIGS. 8 and 9 for example, downsizing of the apparatus is realized effectively. Further, although the embodiments above require disposing the drive motors and the electric parts all below the transfer belt, these may be disposed within the space above the transfer belt in which case as well a similar effect is attained.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

a transfer unit which has a transfer medium moving along a predetermined travel direction;

plural image forming stations which are disposed along the travel direction, each of the image forming stations including a latent image carrier which rotates in a sub scanning direction, an image writer which forms a latent image on the latent image carrier and a developer which has a toner carrier extending along a main scanning direction approximately perpendicular to the sub scanning direction and provides the latent image carrier with toner carried on the toner carrier, to thereby form a toner image;

a driver which drives respective sections of the apparatus so as to superimpose the plural toner images formed by the plural image forming stations one atop the other and form a color image onto the transfer medium;

paired support members which are disposed at the both ends of the plural image forming stations and support the latent image carriers so that the latent image carriers can freely rotate; and an exhaust element which exhausts a space which is surrounded by the paired support members and the plural image forming stations on the opposite side of the transfer medium relative to the plural image forming stations, wherein each of the plural image writers includes a line head in which plural light emitting elements are arranged in a row along in the main scanning direction, the line head being disposed in the vicinity of the associated one of the latent image carriers and forming a latent image on the latent image carrier, the driver includes a plurality of common drive mechanisms each of which transmits rotation drive force developing at a common motor to plural places in the respective sections of the apparatus, the common motors are disposed such that a motor main section of the common motors overlaps the transfer medium or the transfer unit in the in-plane arrangement viewed from the vertical direction perpendicular to both of the main scanning direction and the sub scanning direction, and the motor main sections of the common motors are disposed within the space.

2. The image forming apparatus of claim 1, further comprising a controller which controls the respective sections of the apparatus, wherein the controller is disposed within the space.

3. An image forming apparatus comprising:

a transfer unit which has a transfer medium moving along a predetermined travel direction:

plural image forming stations which are disposed along the travel direction, each of the image forming stations including a latent image carrier which rotates in a sub scanning direction, an image writer which forms a latent image on the latent image carrier and a developer which has a toner carrier extending along a main scanning direction approximately perpendicular to the sub scanning direction and provides the latent image carrier with toner carried on the toner carrier, to thereby form a toner image;

a driver which drives respective sections of the apparatus so as to superimpose the plural toner images formed by the plural image forming stations one atop the other and form a color image onto the transfer medium; and a fixing unit which fixes the color image onto a recording member, wherein each of the plural image writers includes a line head in which plural light emitting elements are arranged in a row along in the main scanning direction, the line head being disposed in the vicinity of the associated one of the latent image carriers and forming a latent image on the latent image carrier, the driver includes a plurality of common drive mechanisms each of which transmits rotation drive force developing at a common motor to plural places in the respective sections of the apparatus, the common motors are disposed such that a motor main section of the common motors overlaps the transfer medium or the transfer unit in the in-plane arrangement viewed from the vertical direction perpendicular to both of the main scanning direction and the sub scanning direction, each of the image forming stations further includes a toner replenishing container, which is disposed at an axial edge portion of the toner carrier, and supplies toner to the developer, each of the toner replenishing containers is disposed so that its entirety or a local part projects beyond the transfer medium when viewed in the in-plane arrangement, the transfer unit transfers to the recording member the color image formed on the transfer medium, the driver includes a fixing drive mechanism which has a dedicated motor and transmits to the fixing unit rotation drive force developing at the dedicated motor, and the dedicated motor is disposed overlapping the toner replenishing containers when viewed in the in-plane arrangement.

4. An image forming apparatus comprising:

a transfer unit which has a transfer medium moving along a predetermined travel direction;

plural image forming stations which are disposed along the travel direction, each of the image forming stations including a latent image carrier which rotates in a sub scanning direction, an image writer which forms a latent image on the latent image carrier and a developer which has a toner carrier extending along a main scanning direction approximately perpendicular to the sub scanning direction and provides the latent image carrier with toner carried on the toner carrier, to thereby form a toner image;

a driver which drives respective sections of the apparatus so as to superimpose the plural toner images formed by the plural image forming stations one atop the other and form a color image onto the transfer medium;

paired support members which are disposed at the both ends of the plural image forming stations and support the latent image carriers so that the latent image carriers can freely rotate; and an exhaust element which exhausts a space which is surrounded by the paired support members and the plural image forming stations on the opposite side of the transfer medium relative to the plural image forming stations, wherein each of the plural image writers includes a line head in which plural light emitting elements are arranged in a row along in the main scanning direction, the line head being disposed in the vicinity of the associated one of the latent image carriers and forming a latent image on the latent image carrier, the driver includes a plurality of common drive mechanisms each of which transmits rotation drive force developing ata common motor to plural places in the respective sections of the apparatus, the common motors are disposed such that a motor main section of the common motors overlaps the transfer medium or the transfer unit in the in-plane arrangement viewed from the vertical direction perpendicular to both of the main scanning direction and the sub scanning direction, each of the image forming stations further includes a toner replenishing container, which is disposed at an axial edge portion of the toner carrier, and supplies toner to the developer, each of the toner replenishing containers is disposed so that its entirety or a local part projects beyond the transfer medium when viewed in the in-plane arrangement, and the motor main sections of the common motors are disposed within the space.

5. The image forming apparatus of claim 4, further comprising a controller which controls the respective sections of the apparatus, wherein the controller is disposed within the space.

* * * * *